US007267531B2

(12) United States Patent
Anderson et al.

(10) Patent No.: US 7,267,531 B2
(45) Date of Patent: Sep. 11, 2007

(54) CURRENT MONITORING SYSTEM AND METHOD FOR METERING PERISTALTIC PUMP

(75) Inventors: Thomas D. Anderson, Monterey, CA (US); Andrew J. Cocking, Ben Lomond, CA (US)

(73) Assignee: JohnsonDiversey, Inc., Sturtevant, WI (US)

( * ) Notice: Subject to any disclaimer, the term of this patent is extended or adjusted under 35 U.S.C. 154(b) by 764 days.

(21) Appl. No.: 10/680,781

(22) Filed: Oct. 6, 2003

(65) Prior Publication Data

US 2005/0074337 A1 Apr. 7, 2005

(51) Int. Cl.
*F04B 49/06* (2006.01)
*B67D 5/30* (2006.01)

(52) U.S. Cl. ..... 417/44.11; 417/53; 222/14; 222/63

(58) Field of Classification Search ..... 417/44.1, 417/44.11, 53; 222/14, 63
See application file for complete search history.

(56) References Cited

U.S. PATENT DOCUMENTS 4,231,707 A 11/1980 Tokorozawa et al. ..... 417/12
4,884,013 A 11/1989 Jackson et al. ..... 318/481
5,024,347 A * 6/1991 Baldwin ..... 222/1
5,630,710 A * 5/1997 Tune et al. ..... 417/326
5,992,686 A * 11/1999 Cline et al. ..... 222/1
6,248,093 B1 * 6/2001 Moberg ..... 604/131
7,111,762 B2 * 9/2006 Saunders et al. ..... 222/382

FOREIGN PATENT DOCUMENTS

EP 0 327 209 A2 8/1989

OTHER PUBLICATIONS

International Search Report for International Application No. PCT/US2004/029271, dated Nov. 29, 2004, 3 pages.

* cited by examiner

*Primary Examiner*—Michael Koczo, Jr.
(74) *Attorney, Agent, or Firm*—Morgan, Lewis & Bockius LLP

(57) ABSTRACT

A pump system includes a peristaltic pump having a rotor, a motor and a controller. The motor is configured to drive the peristaltic pump so as to deliver a liquid product from a source to a receiving location. The controller monitors a drive current of the motor so as to track rotation of the pump's rotor. The controller counts units of rotation of the pump's rotor, and stops the motor when the counted units of rotation reach a specified target count value.

16 Claims, 4 Drawing Sheets

CURRENT MONITORING SYSTEM AND METHOD FOR METERING PERISTALTIC PUMP

FIELD OF THE INVENTION

The present invention relates to the field of pumping devices and systems, and more particularly to systems and methods for measuring or metering the quantity of fluid pumped by a peristaltic pump.

BACKGROUND OF THE INVENTION

Referring to FIG. 1, a peristaltic pump 102 is typically used to deliver either water, or a liquid chemical or mixture, from a source 104 to a receiving device 106 (e.g., a dishwasher, or clothes washer). The peristaltic pump 102 has a rotor 110 (FIG. 2A) with rollers 112 (112-A and 112-B in the example shown in FIG. 2A) that compress a tube 114 as the rotor is rotated. The pump 102 is driven by a motor (not shown in FIG. 1), and liquid is drawn into the tube 114 (also called the tubing) at an inlet 120 and then forced through the tube to an outlet 122 by the rollers of the rotor as the rotor turns on its axis. Operation of the pump 102 is controlled by a controller 130, which typically runs the pump 102 for a fixed or specified amount of time in order to deliver a corresponding amount of product (i.e., the liquid being pumped) to the receiving device 106.

Battery powered peristaltic pumps are inexpensive, and almost all are controlled, so as to deliver a specific amount of product, by controlling the run time of the pump. The run time is typically determined by calibrating the pump. For some pumps, calibration is accomplished by running the pump until a fixed amount of product (e.g., 100 milliliters) is delivered. Then the user programs the pump to deliver a specified multiple of the fixed amount used for calibration. For other pumps, the calibration is accomplished by running the pump until the target amount of product is delivered, and that amount of time is stored in the pump's controller. For such pumps, during normal or production use the pump is run for the same amount of time as was determined during calibration.

Experience has shown that the amount of product delivered by a peristaltic pump decreases as the pump's battery ages. Attempts to modify the pumps's run time based on a measurement of the battery voltage, so as to deliver a constant volume of product, have been largely unsuccessful. The amount of product was found to vary widely, especially from unit to unit of nominally identical pumps (i.e., same model, same type of tubing, etc.). Thus, the volume of product delivered is not well defined by the run time and battery voltage.

It would be beneficial to provide a low cost control mechanism and method, for ensuring that the amount of product delivered by a peristaltic pump remains substantially unchanged despite aging of the pump's battery.

SUMMARY

A pump system includes a peristaltic pump having a rotor, a motor and a controller. The motor is configured to drive the peristaltic pump so as to deliver a liquid product from a source to a receiving location. The controller monitors a drive current of the motor so as to track rotation of the pump's rotor. The controller counts units of rotation of the pump's rotor, and stops the motor when the counted units of rotation reach a specified target count value.

BRIEF DESCRIPTION OF THE DRAWINGS

Features and advantages of the invention are described in detail below in conjunction with the drawings. Like reference numerals designate like portions.

Like reference numbers are used to represent like elements throughout the Figures.

DESCRIPTION OF THE PREFERRED EMBODIMENTS

Theory of Operation

Figure 1:
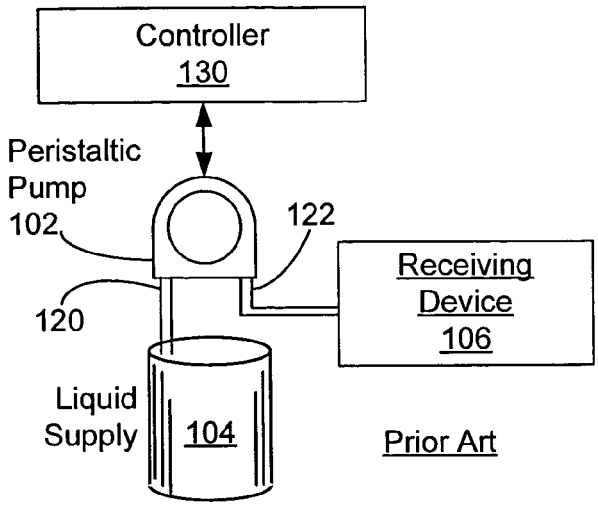
FIG. 1 is a block diagram of a conventional system for pumping a liquid product from a supply to a receiving device.

While a theory of operation is provided, it is to be understood that the invention itself is the apparatus of the invention and the method of operation of the invention. The theory of operation is provided solely to make the apparatus and methods of the invention easier to understand.

FIGS. 2A, 2B, 2C and 2D show the tubing 114, rotor 110 and rollers 112 (112-A, 112-B) of a peristaltic pump, with the rotor and rollers in a sequence of four different positions as the pump rotor 110 turns clockwise. The rotor and rollers are sometimes called a pump head assembly or pump head. The number of rollers 112 on the rotor 110 may vary from one pump to another, and this number is typically 2, 3 or 4. The function of the rollers is to compress the tubing as the rotor rotates, and to thereby move product through the tubing from in the inlet 120 to the outlet 122. For purposes of explaining the theory of operation of the invention, we will explain the operation of a pump having a rotor 110 with two rollers 112, but the invention can also be used to rotors having more than two rollers. Also for purposes of explaining the theory of operation of the invention, we will assume that the rotor 110 rotates clockwise. However, operation of the invention is independent of the direction (clockwise or counterclockwise) of the rotor.

Figure 2A:
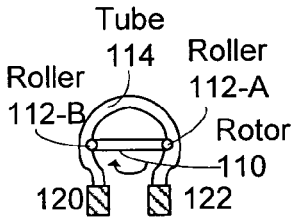
FIGS. 2A, 2B, 2C and 2D depict a portion of a peristaltic pump at four positions of the pump's rotor.
Figure 2B:
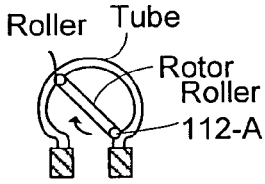
Figure 2C:
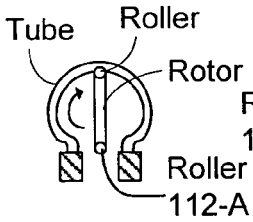
Figure 2D:
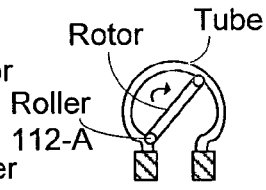

In FIG. 2A, both rollers 112-A, 112-B are compressing the pump tubing 114. In FIG. 2B, one roller 112-A is leaving contact with the tubing while the other roller 112-B continues to compress the tubing 114. In FIG. 2C one roller 112-A is not touching any tubing while the other roller 112-B is compressing the tubing 114. In FIG. 2D the roller 112-A that was previously not touching the tubing begins to compress the tubing 114 again, while the other roller 112-B continues to compress the tubing 114. The four states of the pump represented by FIGS. 2A, 2B, 2C and 2D will herein be called states A, B, C and D, respectively.

For purposes of explaining the theory of operation of the invention, states B and D are the most interesting, because it is in these two states that the motor provides different amounts of torque. Due to the physical characteristics of conventional motors, changes in torque cause corresponding changes in drive current. In other words, the amount of current drawn by the motor from a power supply (e.g., a battery or other power source) varies with the amount of torque provided by the motor. As any roller 112 leaves the pump tubing, as shown in FIG. 2B, the tube 114 acts as a spring and pushes the roller. This causes the pump to provide less torque (because less force is needed to turn the rotor 110), and thus the motor uses less current. When any roller 112 re-engages with the tubing, as shown in FIG. 2D, re-compressing the tube, the tube acts like a spring being compressed. This action requires the motor to provide additional torque, which causes the motor to draw more current.

Figure 3:
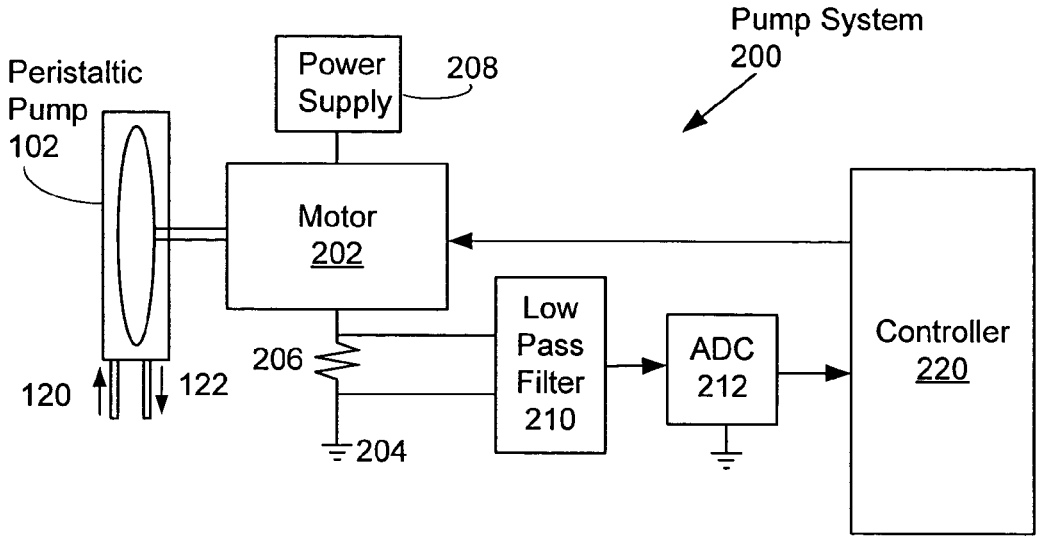
FIG. 3 is a block diagram of an improved system for pumping a liquid from a supply to a receiving device.
Figure 4:
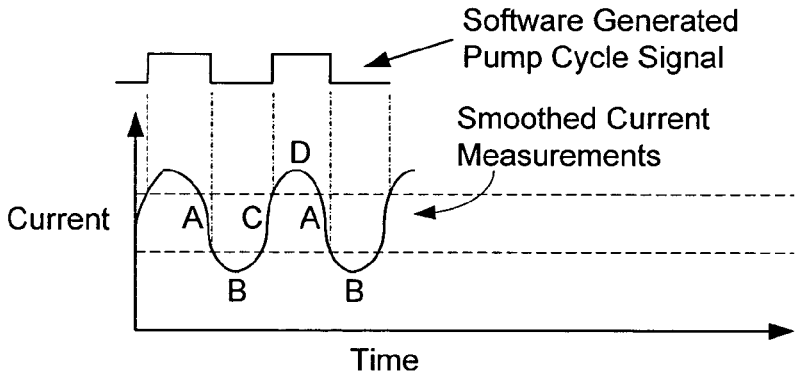
FIG. 4 is a timing diagram useful for explaining the current based control method used in the system of FIG. 3.

FIG. 4 shows a graph of the current drawn by a motor over time as the pump's rotor rotates and the pump progresses through the four states A, B, C and D. In state B (decompression of the tube) the motor draws the least amount of current and in state D (recompression of the tube) the motor draws the most amount of current. As will be explained next, with reference to FIG. 3, by monitoring the current drawn by the pump motor, a pump controller 220 can count the number of rotations of the pump's rotor, with each complete current cycle representing a predefined amount of rotation of the pump's rotor.

Pump System with Controller

FIG. 3 represents a peristaltic pump system 200 having a peristaltic pump 102, a motor 202 for driving the pump 102, a power supply 208 (e.g., a battery or other power source), and a controller 220 for monitoring and controlling the operation of the motor 202. In some embodiments the motor 202 is coupled to a circuit ground 204 by a current sensor 206, such a high precision, low resistance resistor. In one embodiment, the current sensor 206 is a 0.050 ohm resistor having a resistance precision of about one percent (1%). The resistance and precision of the current sensing resistor 206 may vary in other embodiments, but generally the resistance should be sufficiently low as to avoid wasting power and to avoid interfering with the operation of the motor.

In some embodiments the controller 220 is a programmed microcontroller, such as an 8 or 16 bit microcontroller. For example, the microcontroller may be a MSP430F435 made by Texas Instruments. In some embodiments the controller 220 is coupled to the current sensor 206 by a low pass filter 210 and an analog to digital converter (ADC) 212. In some embodiments, the ADC 212 is embedded within the microcontroller 220, while in other embodiments the ADC 212 is external to the microcontroller 220. In some embodiments, the ADC 212 has an accuracy of eight or more bits.

The current drawn by a motor is typically a very noisy signal (herein called the current signal), and thus is not as smooth as shown in FIG. 4. The current signal shown in FIG. 4 has been low pass filtered and smoothed. In some embodiments, the signal to noise ratio of the current signal is about 1.5 to 1. To extract useful information from the current signal, the system shown in FIGS. 3 and 5 low pass filters the current signal, using both analog and digital filtering techniques, and furthermore uses a hysteresis methodology to ensure proper pump cycle counting.

In some embodiments, the pump 202 motor has a maximum speed of about 150 revolutions per minute (rpm). With two rollers, this corresponds to a maximum of 300 current cycles (as shown in FIG. 4) per minute. Three hundred (300) cycles per minute is equal to 5 cycles per second, and therefore the portions of the current signal of interest will have a maximum frequency component of about 20 Hz (corresponding to eight samples per cycle of the current signal, and thus four times the fundamental frequency of the current signal).

In some embodiments, the low pass filter 210 is implemented as an RC filter. The RC filter has a resistor and a capacitor whose resistance R and capacitance C, respectively, are selected to have a 3 db point of approximately 25 Hz. In other words, $$\frac{1}{RC}$$

of the RC filter is equal to about 25. For instance, an RC filter having a resistor of about 430 K ohms, and a capacitor of about 0.1 microfarads would provide a 3 db cutoff frequency of about 23 Hz.

In one embodiment, the microcontroller 220 is programmed to sample the current signal about 1300 times per second. In particular, the microcontroller 220 commands the ADC 212 to sample and produce digital samples of the voltage across resistor 206 about 1300 times per second. The resulting stream of digital values corresponds to the amount of current drawn by the motor over time. This stream of digital values, representing the monitored motor current, has already been low pass filtered by the low pass filter 210. In fact, the sampling rate of 1300 times per second is significantly higher than the Nyquist sampling rate of about 50 samples per second associated with the cutoff frequency of the low pass filter 210. The microcontroller 220 smoothes the digital motor current signal by computing a 32 sample rolling average of the signal, which reduces the effective sampling rate of the monitored motor current to about 40 times per second, which is just below the Nyquist sampling rate.

Controller

Figure 5:
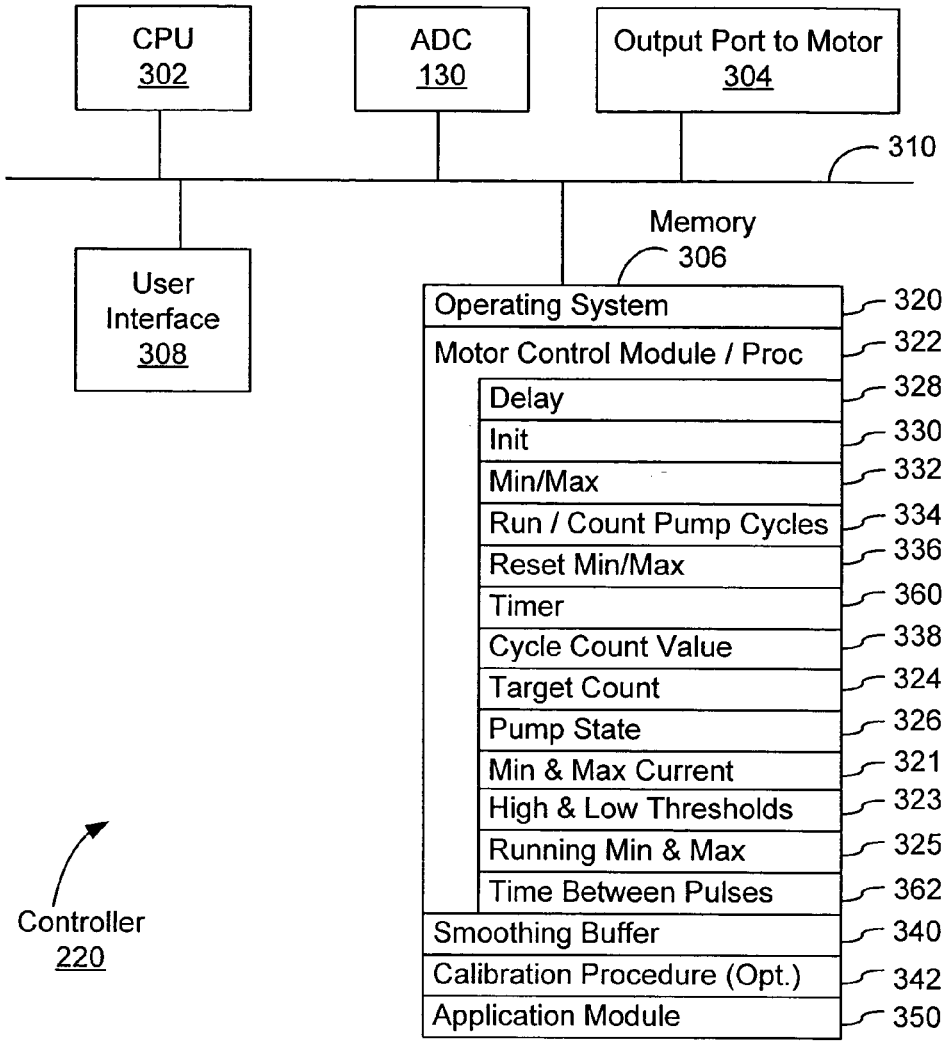
FIG. 5 is a block diagram of the controller in the system shown in FIG. 3.

Referring to FIG. 5, in an exemplary embodiment the controller 220 includes a central processing unit (CPU) 302, the analog to digital converter 130, an output port 304 for controlling the motor (i.e., for turning it on and off), memory 306 and a user interface 308. The CPU 302 executes procedures stored in the memory 306. The user interface may be as simple as a key pad and a small LCD screen or the like, or may be more robust. The memory typically includes both volatile and non-volatile memory arrays, for storing software and data. In some embodiments, the memory 306 of the controller includes modules, instructions and data arrays including:

- an operating system 320, or a set of procedures for performing basic system operations such as accessing input/output ports, keeping track of the passage of time, controlling the ADC 130, and the like;
- a smoothing buffer 340 (i.e., a set of memory locations), used to store raw current measurement values received from the ADC 130;
- motor control procedures 322;
- optionally, a calibration procedure 342 for calibrating the pump; and
- optionally, one or more application modules 350, which provide overall control of the pump system in which the controller is used.

The motor control module 322 includes, in a preferred embodiment, procedures, instructions and data including:

- Delay state 328, Init state 330, Min/Max state 332, Run state 334, and Reset Min/Max state 336 control instructions, for running the controller in the Delay, Init, Min/Max, Run and Reset Min/Max states (which are described below);
- a Target Count 324 value; and
- a Cycle Count Value 338;
- pump state values 326, representing the state of the controller (see FIG. 6) and whether the last threshold crossed was the Low or High Threshold;
- Min and Max current values 321;
- High and Low Threshold values 323;
- Running Min and Max current values 325; and
- a Time Between Pulses value 362, indicating the running speed of the pump.

In some embodiments, the Cycle Count Value 338 is stored in a register of the CPU 302, and is not stored in the main memory of controller 322. In one embodiment, where the pump has two rollers 112 (FIG. 2), the Cycle Count Value represents the number of half revolutions that the pump rotor has turned since the motor was turned on. In some embodiments, the Reset Min/Max state is not used and therefore this procedure or instructions are not included.

Controller States

Figure 6:
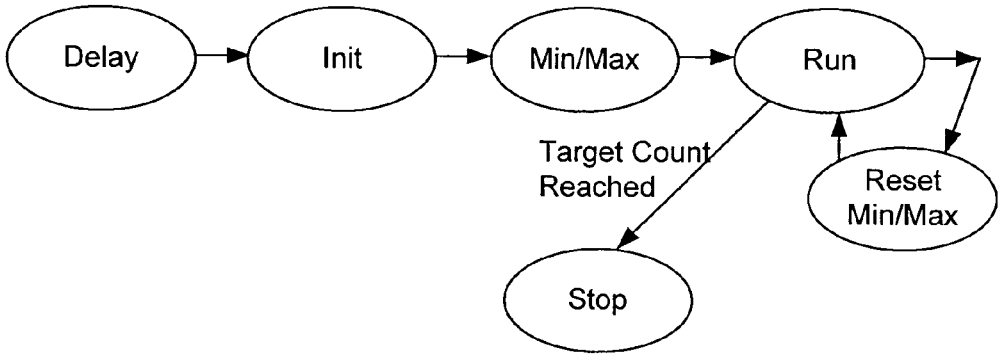
FIG. 6 is a state diagram of the pumping system of FIGS. 3 and 5.

Referring to FIG. 6, the controller 220 has several operating states. When the motor is turned on, the controller enters the Delay state for a short period of time, for example about 250 msec (a quarter second). Any digital samples of the current signal taken during this time period are ignored, because there is often a current spike when the pump motor begins to run. In some embodiments, the controller takes no samples of the current signal during the Delay period.

In the Init state, Min/Max state and the Run state, the controller samples the current signal at a predefined sampling rate (e.g., about 1300 times per second in one embodiment), stores the raw current sample values in a smoothing buffer (340, FIG. 5), and also computes a running 32 sample average of the current signal. This smoothed digital signal is then used for all computations. For instance, each computed smoothed current value is compared with the Running Min and Max values 325. If the smoothed current value exceeds the Running Max value, the Running Max value is replaced with the smoothed current value. Similarly, if the smoothed current value is less than the Running Min value, the Running Min value is replaced with the smoothed current value. In a preferred embodiment, the smoothing buffer 340 is used as a circular buffer, with new raw current values being written into a "next" slot of the buffer in circular fashion. Every time a new raw current value is written to the smoothing buffer 340, a new smoothed current value is computed, and then processed. The processing of the smoothed current value when the controller is in the Run state includes running Min/Max processing, and threshold crossing checking, as described below.

Next, in the Init state, the controller samples the current signal, smoothes the samples using time averaging, and determines the minimum and maximum current value during the Init time period. The smoothed values of the current signal do not need to be scaled because the only use of the current signal samples is to detect complete current cycles. The number of samples taken in the Init state should be sufficient to ensure that both the highest and lowest current levels of the motor are sampled, such as by sampling the current signal for at least an entire current period (as shown in FIG. 4) and preferably two to ten current periods. The Init state may therefore be very short, on the order of the time for one to five rotations of the pump. The Init state typically lasts a second or less.

At the start of the Init state the Running Min and Max values 325 are set to the value of a first smoothed current value. Then, each smoothed current value obtained during the Init stat is compared with the Running Min and Max values 325, and the Running Min and Max values are updated so as to equal the minimum and maximum smoothed current values observed during this time period. At the end of the Init state period, the Running Min and Max values are saved as the Min and Max current values 321, and the controller computes High and Low Threshold values based on these minimum and maximum values.

In the Min/Max state, which follows the Init state, the controller determines the Low and High Threshold values 323, based on the Min and Max current values 321. In some embodiments, the threshold values are determined by computing the difference between the maximum and minimum values ($\Delta C$), setting the Low Threshold to the minimum current value plus a first fraction F1 of the difference $$(\text{Low Threshold}=\text{Minimum Current}+F1\times\Delta C),$$

and setting the High Threshold to the minimum current value plus a second fraction F2 of the difference $$(\text{High Threshold}=\text{Minimum Current}+F2\times\Delta C),$$

where the second fraction is larger than the first fraction. In one embodiment, the Low Threshold is set to the minimum current value plus three eights (3/8) of the difference $$\left(\text{Low Threshold} = \text{Minimum Current} + \frac{3}{8}\Delta C\right),$$

and the High Threshold value is set to the minimum current value plus two thirds (5/8) of the difference $$\left(\text{High Threshold} = \text{Minimum Current} + \frac{5}{8}\Delta C\right).$$

Other values of the first and second fractions (e.g., 1/4 and 3/4, or 5/16 and 11/16) may be used in other embodiments In some embodiments, while still in the Min/Max state the controller initializes the Cycle Count Value 338 (FIG. 5) to an estimate of the number of current cycles that have occurred since the motor was turned on. To do this, the controller monitors the smoothed current data until the smoothed current falls below the Low Threshold, and then rises above the High Threshold. At this point the controller starts a timer 360. The controller then monitors the smoothed current data until the smoothed current falls below the Low Threshold, and then rises above the High Threshold. At this point the controller checks the timer 360 to determine the amount of time that has elapsed between current pulses (e.g., the time between upward transitions across the High Threshold) and then divides the run time of the motor by this amount of time. In addition, the controller restarts the timer 360. The amount of time measured by the timer is stored in the Time Between Pulses value 362 in the controller's memory. In some embodiments, the Time Between Pulses value 362 is equal to the number of current value samples between crossings of the High Threshold value. There is no need to convert this value into seconds or other time unit, since its only use is to determine the number of pump rotations while the pump was running prior to entering the Run state. In some embodiments, the controller initializes the pump cycle count to zero and then adjusts that value at the end of a predefined amount of motor run time in the Run state, using the same timer-based methodology as explained here. In some embodiments, a different or more complex function may be used to compute the cycle count correction value, for example as a function of the average cycle time and the motor run time prior to entering the Run state.

In some embodiments, the timer 360 is implemented in software executed by the controller. Whenever the timer 360 is reset, its value is set to a predefined starting value. Each time the motor current is sampled by the controller, the timer's value is updated by either incrementing or decrementing its value, depending on the implementation. When the timer 360 is about to be reset, the timer's value is read and the difference between its predefined starting value and its current value is equal to the cycle period of the pump cycle that just completed, herein called the current cycle period. In other embodiments, the timer 360 may be implemented so as to measure time in conventional or other time units.

While monitoring the pump cycles (also herein called current cycles) in the Min/Max state and the Run State, each time the controller detects that the smoothed current value has fallen below the Low Threshold the controller sets a hysteresis bit within the Pump State 326 to indicate a "Low" state, and each time the controller detects that the smoothed current value has risen above the High Threshold the controller sets the hysteresis bit within the Pump State 326 to indicate a "High" state. The hysteresis bit is used by the controller to know which Threshold value is to be compared with the smoothed current values, and thus where in the pump cycle (as shown in FIG. 4) the pump is currently operating.

After completing the Min/Max state operations, the controller enters the Run state. The current state of the controller is stored in the Pump state 326 in the controller's memory.

In the Run state, the controller monitors the motor current for threshold crossings, implementing a hysteresis method of counting current cycles. In particular, the controller monitors the current until it falls below the Low Threshold, and then monitors the current until it rises above the High Threshold. At this point, the controller increments its Cycle Count Value 338. In addition, the controller stores an elapsed time value since the last High Threshold crossing in the Time Between Pulses value 362, and resets the timer. In some embodiments, the timer is implemented as a periodic down counter that causes a system interrupt if it expires without being reset. In this way, if the pump becomes jammed or the system otherwise fails, the controller is notified that a system error has occurred. In an alternate embodiment, the controller first monitors the current until it rises above the High Threshold, and then monitors the current until it falls below the Low Threshold, and at that point the controller increments the Cycle Count Value 338. Each time the cycle count value 338 is incremented, the controller compares the Cycle Count Value 338 with a Target Count Value 324, and stops the motor when the cycle counter equals the Target Count Value 324. At this point the controller enters the Stop state.

Each cycle count by the controller indicates the delivery of a corresponding amount of product by the pump (see FIGS. 1 and 3). In embodiments in which the pump has two rollers, each cycle count corresponds to a half revolution of the pump rotor, which corresponds to an amount of product delivered for each half revolution of the pump rotor. More generally, when using a peristaltic pump having M rollers, where M is an integer greater than one, each cycle count corresponds to 1/M revolutions of the pump rotor, which corresponds to an amount of product delivered for each 1/M revolution of the pump rotor.

In some embodiments, the Target Count Value 324 is determined by the application module 350. In some embodiments the target count value is programmed by a user through the use of the user interface 308 and a Calibration procedure 342 that is configured to enable a user to specify the Target Count Value. The Target Count Value may be determined by running the pump in a "calibration" mode until a fixed or predetermined amount of product is delivered. During calibration, the controller counts current cycles. The end of the calibration mode may be signaled by a user pressing or releasing a button on the user interface 308. In some embodiments, the current count is displayed on the user interface 308. In some embodiments, a final value of the current count is stored in the controller's memory as the target value. In some embodiments, an application module 350 uses the final count value as a base value for determining the target value. For instance, if 100 milliliters (ml) of product are delivered during the calibration mode, and the amount of product to be delivered during a particular operation is 750 ml, then the application module 350 will set the target value to be 7.5 times the base value determined during the calibration mode.

In some embodiments, the controller periodically recalibrates the High and Low Threshold values 323, briefly entering the Reset Min/Max state. In one embodiment, after each N seconds of Run state operation (e.g., four seconds of Run state operation), the controller recomputes the High and Low Threshold values. It does this by clearing the Running Min and Max values 325 at the start of each N second period (e.g., by setting both values to the last smoothed current value computed by the controller), comparing each subsequent smoothed current value with the Running Min and Max values, and updating the Running Min and Max values to be equal to the minimum and maximum smoothed current values produced during the N second period. At the end of the N second period, the controller replaces the Min and Max current values with the Running Min and Max values, re-initializes the Running Min and Max values (e.g., to an intermediate value between the Low and High Threshold values), and re-computes the High and Low Threshold values as a function of the Min and Max current values.

The computation performed by the controller in the Reset Min/Max state typically takes only a small fraction of a second. In some embodiments, the execution time required by the Reset Min/Max state is less than the amount of time between the completion of processing a current sample and the receipt of a next current sample (which takes about 770 microseconds in one embodiment). Thus, the Reset Min/Max state does not interfere with the operation of the controller in the Run state. In some embodiments, the Reset Min/Max state is not included, in which case the High and Low Threshold values established in the Min/Max state are used until the pump finishes delivering product for the specified number of current cycles.

In some embodiments, the rate of sampling of the current signal is lower or higher than 1300 samples per second. In some embodiments, the number of samples averaged to produce a smoothed current signal is more or less than 32. More generally, as will be understood by those of skill in the art, all the parameters used in the design of the exemplary pump system described above will vary in accordance with the maximum speed of the pump motor and the number of rollers on the pump rotor.

Additional Noise Correction

Figure 7:
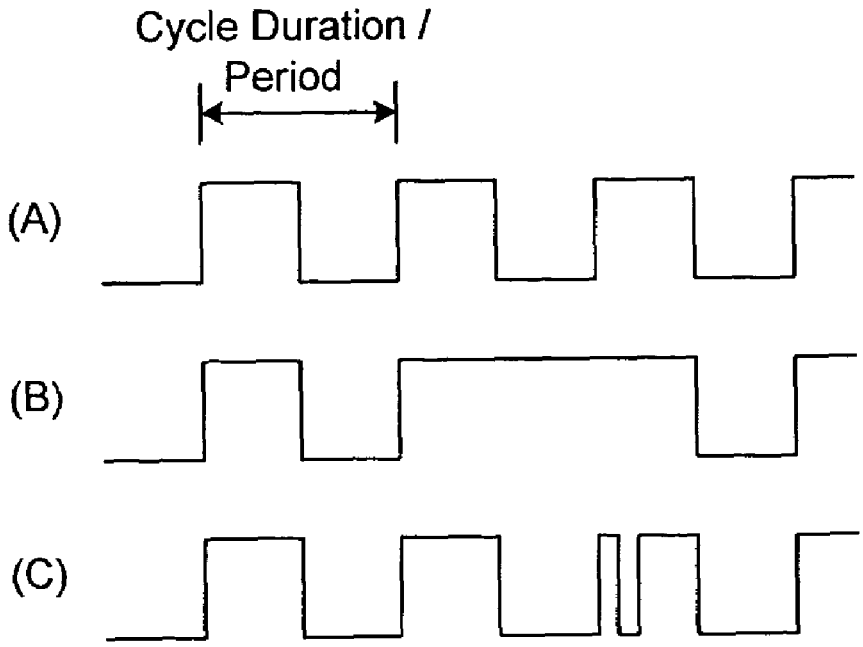
FIG. 7 depicts waveforms showing examples of correct and mistaken tracking of pump cycles.

In some embodiments, the noise filtering measures described above are insufficient to avoid errors in counting pump cycles. In such embodiments, additional signal processing is performed so as to accurately count pump cycles. Referring to FIG. 7, signal trace A represents a correct representation of the pump state. This is a time line representation of the Pump State signal 326, based on the monitored motor current signal. The duration between like Pump State transitions (e.g., from one upward transition to another) is called the cycle duration or period. Signal trace B represents what happens when the controller misses a pulse, in this example by missing a downward transition of the motor current signal, due to signal noise. The duration between two like transitions of the Pump State signal will be about twice as long as normal when a single Pump State transition is missed. Signal trace C represents what happens when the controller incorrectly "detects" an extra Pump State transition due to signal noise. If the hysteresis thresholds are too close to each other, that may also cause the controller to detect phantom Pump State transitions. As shown, the duration between two like transitions of the Pump State signal will be shorter than normal when a phantom Pump State transition is detected.

Figure 8:
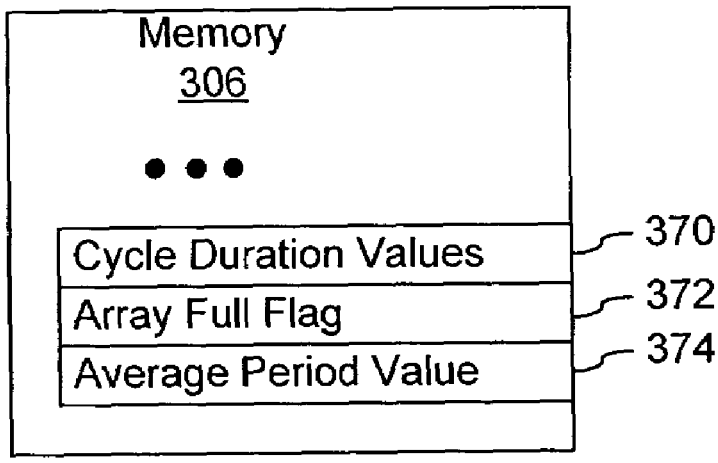
FIG. 8 depicts additional data structures stored in memory of a pump system controller.

Missed signal transitions and phantom signal transitions both cause the Cycle Count Value 338 to be incorrect, unless corrective actions are taken. Referring to FIG. 8, in some embodiments additional data is stored in the controller's memory 330 to compensate for missed and phantom pump cycles. The data structures shown in FIG. 8 are used in addition to the programs and data structures included in memory 330 of the controller 220 shown in FIG. 5. As described above, the controller 220 (FIG. 5) restarts a timer each time the smoothed current signal rises above the High Threshold, after having fallen below the Low Threshold. (As noted above, while this description describes the controller as performing most cycle processing after upward transitions of the smoothed current signal, in other embodiments these operations of the controller are performed after downward transitions of the smoothed current signal.) In addition, in embodiments represented by FIG. 8, prior to restarting the timer, the controller reads the timer, which indicates the number of signal sample periods since the timer was last restarted, and stores this value in a data array 370. In these embodiments data array 370 is used instead of the memory location 362 to store the Time Between Pulses. Data array 370 is configured to store P distinct cycle period values and is used by the controller as a circular buffer. Thus, the controller writes each new cycle period value into a next position in the array 370, where the position after the last position in the array is the first position in the array. In some embodiments, P (the number of period values stored in the array 370) is between 5 and 25, and in one embodiment P is equal to 8.

In addition, to writing the current cycle period value into array 370, the controller compares the current cycle period value (called the Timer Value in the pseudo code of Table 1) with the average cycle period for the P prior cycle periods multiplied by a factor Y.

TimerValue?>Y×AveragePeriod

In some embodiments Y is a value between 1.2 and 1.5, inclusive. In one embodiment, Y is equal to 1.25. If the current cycle period value is greater than this amount, the cycle count value is increased by 1 to compensate for a missed pump cycle. However, the instructions for detecting and compensating for a missed pump cycle are not performed if the array 370 has not yet been filled with cycle period values, because the array 370 needs to be filled in order to accurately compute an average cycle period (called the AveragePeriod in the pseudo code of Table 1). Thus, during the first P cycle periods of operation, the controller is unable to detect and compensate for missed cycles. In another embodiment, in order to correct for multiple missed cycles, the correction to the cycle count value is determined by dividing the current cycle period by the average period, and rounding the resulting quotient to an integer value.

In some embodiments, the false detection of phantom pump cycles is avoided by ignoring all state transitions that occur within X sample periods of the last state transition. In some embodiments, X is a value between 3 and 15, and in one embodiment X is equal to 4, and in another embodiment X is equal to 5. By simply ignoring closely spaced state transitions, current spikes that occur shortly after a state transition do not adversely affect the pump cycle count.

In an alternate embodiment, the controller avoids detection of phantom pump cycles by detecting when the current cycle period is less than a factor Z multiplied by the average cycle period, where Z is a value between 0.5 and 0.8, and is equal to 0.75 in one embodiment. Thus, the cycle counter is not incremented (or is incremented and then decremented) when a pump cycle that is shorter than Z×AveragePeriod is detected.

A pseudo code representation of the actions that the controller takes, while in the Run State, upon receiving each new current sample is shown in Table 1.

TABLE 1

Controller Pseudo Code for Run State

```
Receive new current sample
Store current sample in circular buffer
Compute smoothed current value
Update Timer /* Timer counts current sample periods */
/* To avoid counting phantom cycles, exit the Run State procedure
until the next current sample if the time (measured
in units of current sample periods) since the last
state transition is less than a threshold value, X */
If Time since last State Transition is < X {
  Return
  }
/* Detect downward transition of smoothed current signal */
If Pump State = High {
  If smoothed current value < Low Threshold {
    Set Pump State = Low }
  }
/* Check for End/Start of Pump Cycle */
If Pump State = Low {
  If smoothed current value > High Threshold {
    Set Pump State = High
    Cycle Count = Cycle Count + 1
    Read Timer Value
    Store Timer Value in next position in Cycle Period Value array
    Reset Timer
    /* Perform cycle check & correction - but only if array is full */
    If Cycle Period Value array is full {
      /* Check and Correct for Missed Cycle */
```

TABLE 1-continued

| Controller Pseudo Code for Run State |
|---|
| If Timer Value > Y * AveragePeriod { |
| Cycle Count = Cycle Count + 1 } |
| /* update AveragePeriod */ |
| AveragePeriod = Average of values in Cycle Period Value array |
| } |
| } /* end of Pump Cycle Check |
| Return |

The foregoing description, for purposes of explanation, has been described with reference to specific embodiments. However, the illustrative discussions above are not intended to be exhaustive or to limit the invention to the precise forms disclosed. Many modifications or variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A method of controlling a peristaltic pump so as to deliver a particular amount of liquid product, comprising:

driving a motor so as to operate the pump and to thereby deliver the liquid product from a source to a receiving location;

monitoring a drive current of the motor so as to track rotation of the pump's rotor;

counting units of rotation of the pump's rotor; and stopping the motor when the counted units of rotation reach a specified target count value, the specified target value corresponding to a total amount of liquid product to be delivered;

the monitoring and counting operations including:

detecting when the monitored drive current falls below a first threshold;

detecting when the monitored drive current rises above a second threshold, wherein the second threshold is higher than the first threshold; and updating the counted units when the monitored drive current rises above the second threshold after having fallen below the first threshold, or when the monitored drive current falls below the first threshold after rising above the second threshold.

2. The method of claim 1, including determining an average duration of a plurality of prior units of rotation of the pump's rotor;

determining a duration of a current unit of rotation of the pump's rotor;

comparing the determined duration of the current unit with the determined average duration and adjusting the counted units when the comparison meets predefined error detection criteria.

3. The method of claim 1, wherein the monitoring includes sampling the drive current for a duration to produce a sequence of sample values, determining maximum and minimum sample values from the sequence of sample values, and determining the first and second threshold values based on the maximum and minimum sample values.

4. The method of claim 1, wherein the monitoring includes performing a pump calibration, including sampling the drive current for a duration to produce a sequence of sample values, determining maximum and minimum sample values from the sequence of sample values, and determining first and second threshold values based on the maximum and minimum sample values.

5. The method of claim 4, including periodically performing the pump calibration.

6. The method of claim 1, wherein the monitoring includes sampling the drive current at a predefined rate, storing digital values produced by the sampling in a buffer, and computing a running average of the digital values stored in the buffer so as to produce a smoothed current signal.

7. The method of claim 1, wherein the monitoring includes low pass filtering the drive current using both an analog filter and a digital filter.

8. The method of claim 1, including determining an average duration of a plurality of prior units of rotation of the pump's rotor;

determining a duration of a current unit of rotation of the pump's rotor;

comparing the determined duration of the current unit with the determined average duration and adjusting the counted units when the comparison meets predefined error detection criteria.

9. A pump system, comprising:

a peristaltic pump having a rotor;

a motor configured to drive the peristaltic pump so as to deliver a liquid product from a source to a receiving location; and a controller coupled to the motor and configured to monitor a drive current of the motor so as to track rotation of the pump's rotor, to count units of rotation of the pump's rotor, and to stop the motor when the counted units of rotation reach a specified target count value, the specified target value corresponding to a total amount of liquid product to be delivered;

wherein the controller is configured to detect when the monitored drive current falls below a first threshold, to detect when the monitored drive current rises above a second threshold, wherein the second threshold is higher than the first threshold, and to update the counted units when the monitored drive current rises above the second threshold after having fallen below the first threshold or when the monitored drive current falls below the first threshold after rising above the second threshold.

10. The pump system of claim 9, wherein the controller is further configured to:

determine an average duration of a plurality of prior units of rotation of the pump's rotor;

determine a duration of a current unit of rotation of the pump's rotor;

compare the determined duration of the current unit with the determined average duration and adjust the counted units of rotation of the pump's rotor when the comparison meets predefined error detection criteria.

11. The pump system of claim 9, wherein the controller is configured to sample the drive current for a duration to produce a sequence of sample values, to determine maximum and minimum sample values from the sequence of sample values, and to determine the first and second threshold values based on the maximum and minimum sample values.

12. The pump system of claim 9, wherein the controller is configured to perform a pump calibration, including sampling the drive current for a duration to produce a sequence of sample values, determining maximum and minimum sample values from the sequence of sample values, and determining first and second threshold values based on the maximum and minimum sample values.

13. The pump system of claim 12, wherein the controller is configured to periodically perform the pump calibration.

14. The pump system of claim 9, wherein the controller is configured to sample the drive current at a predefined rate, store digital values produced by the sampling in a buffer, and compute a running average of the digital values stored in the buffer so as to produce a smoothed current signal.

15. The pump system of claim 9, wherein the controller is configured to low pass filter the drive current using both an analog filter and a digital filter.

16. The pump system of claim 9, wherein the controller is further configured to:

determine an average duration of a plurality of prior units of rotation of the pump's rotor;

determine a duration of a current unit of rotation of the pump's rotor;

compare the determined duration of the current unit with the determined average duration and adjust the counted units of rotation of the pump's rotor when the comparison meets predefined error detection criteria.

* * * * *